United States Patent [19]

Burr et al.

[11] 4,148,429

[45] Apr. 10, 1979

[54] RECEPTACLE WITH SELF-LOCKING CLOSURE

[75] Inventors: Richard R. Burr, Neenah; Lyle G. Gabrielson, Menasha; Richard R. Masten, Jr., Neenah, all of Wis.

[73] Assignee: Menasha Corporation, Menasha, Wis.

[21] Appl. No.: 901,072

[22] Filed: Apr. 28, 1978

[51] Int. Cl.[2] ..... B65D 5/22; B65D 5/24; B65D 45/00

[52] U.S. Cl. ..... 229/36; 229/45 R; 229/31 FS

[58] Field of Search ..... 229/33, 36, 34 R, 31 FS, 229/45, 31 R

[56] References Cited

U.S. PATENT DOCUMENTS

| | | | |
|---|---|---|---|
| 2,373,730 | 4/1945 | Williamson et al. | 229/31 FS |
| 2,407,463 | 9/1946 | Williams | 229/45 |
| 2,597,848 | 5/1952 | Reeser | 229/45 X |
| 2,754,046 | 7/1956 | Roberts | 229/45 |
| 2,757,849 | 8/1956 | Duff, Jr. | 229/45 X |
| 2,758,781 | 8/1956 | White | 229/45 |
| 3,395,850 | 8/1968 | Kotowick | 229/36 |
| 3,511,429 | 5/1970 | Brian | 229/31 FS |
| 3,531,041 | 9/1970 | Rohde | 229/31 FS X |

*Primary Examiner*—Davis T. Moorhead
*Attorney, Agent, or Firm*—Andrus, Sceales, Starke & Sawall

[57] ABSTRACT

A receptacle having a self-locking closure is formed by fold assembly of an appropriately scored single piece blank. The receptacle formed from the sheet material blank includes forward, rear and opposed side walls connected to a bottom and providing for an upwardly facing opening. Corner gussets provided for on the blank are foldable in opposed relation along the outside face of the forward and rear walls of the receptacle. The blank further includes a projecting flap and first locking tab on the forward and rear walls with the flap being foldable outwardly and downwardly to hold the opposed gussets in place while the first locking tab is foldable upwardly under the opposed gussets to provide for lasting securement for the receptacle in an open condition. Closure flaps for the receptacle are provided on the opposed side walls and are foldable downwardly over the receptacle opening in overlapping relation. The closure flaps each include opposed forward and rear extensions foldable downwardly over the corresponding forward and rear projecting flaps in their folded condition. The overlying closure flap holds the opposed closure flap in place and is provided with a second locking tab on its forward and rear extensions. Each of the second locking tabs are foldable upwardly and under the corresponding first locking tabs to provide for lasting securement for the receptacle closure. The disclosure further contemplates that each of the closure flaps may provide for self-locking closure.

12 Claims, 11 Drawing Figures

RECEPTACLE WITH SELF-LOCKING CLOSURE

BACKGROUND OF THE INVENTION

The invention relates to a receptacle having selflocking closure means and is made from a single paperboard blank appropriately scored for fold assembly.

Hot melt adhesive materials are customarily poured into receptacles in a liquid state at temperatures up to 375° F. The material is then allowed to cool to form a solid block within its receptacle. Heretofore, when the receptacles were made of paperboard, the contents had to be at least partially cooled before closure and sealing with an adhesive-type tape. The procedure required provision for cooling area and involved extra handling which not only contributed to the total cost of the product, but also exposed the contents to some risk of possible contamination. At the point of use, knives were necessary to undo the tape sealed closure to effect release of the block of adhesive material. Paper residue and tape fibers often accompanied the released block as contaminants having a deleterious effect on the resultant product. It is generally an object of this invention to provide an improved paperboard receptacle for use with hot melt adhesives and which is formed from a single blank wherein means for self-locking closure for the receptacle from a part of the blank. It is contemplated that the receptacle of this invention may well have other and diverse uses.

SUMMARY OF THE INVENTION

Broadly the invention contemplates a receptacle formed from a single piece blank of sheet material appropriately scored for fold assembly. The blank provides for a receptacle having forward, rear and opposed side walls integrally connected to a bottom and providing for an upwardly facing opening. The blank also includes corner gussets which are foldable in opposed relation along the outside face of the forward and rear walls of the receptacle. The blank further includes a projecting flap and first locking tab on the forward and rear walls with the flap being foldable outwardly and downwardly to hold the opposed gussets in place while the first locking tab in foldable upwardly under the gussets to provide a lasting securement for the receptacle in an open condition. The blank further has closure flaps on each of the opposed side walls which are foldable downwardly over the receptacle opening in overlapping relation. The closure flaps each include opposed forward and rear extensions foldable downwardly over the corresponding forward and rear projecting flaps in their foldable condition. The overlying closure flap holds the opposed closure flap in place and is provided with a second locking tab on its forward and rear extensions. Each of the second locking tabs are foldable upwardly and under the corresponding first locking tabs to provide for lasting securement for the receptacle closure.

According to a further aspect of the invention, the blank may provide for self-locking closure means for each of the closure flaps of the receptacle.

DESCRIPTION OF THE DRAWING FIGURES

The drawings furnished herewith illustrate the best mode presently contemplated for carrying out the invention and are described hereinafter.

Figure 7:
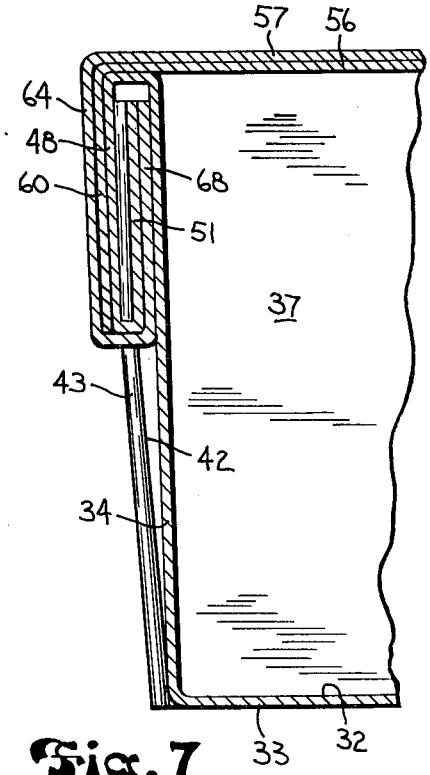
FIG. 7 is a section taken on line 7—7 of FIG. 6 ot show in further detail the mode of folding at the respective ends of the receptacle to provide for self-locking closure without need for glue, tape or other fastening means.
Figure 11:
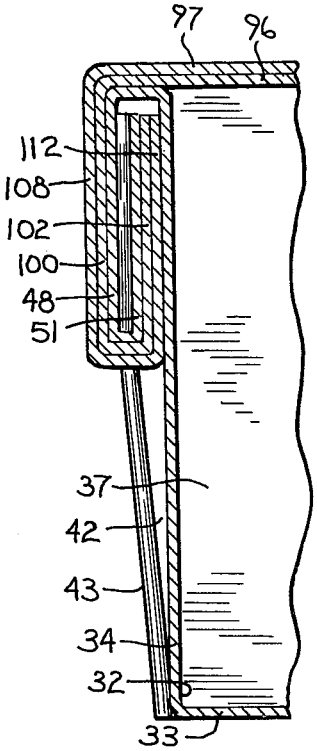
Figure 10:
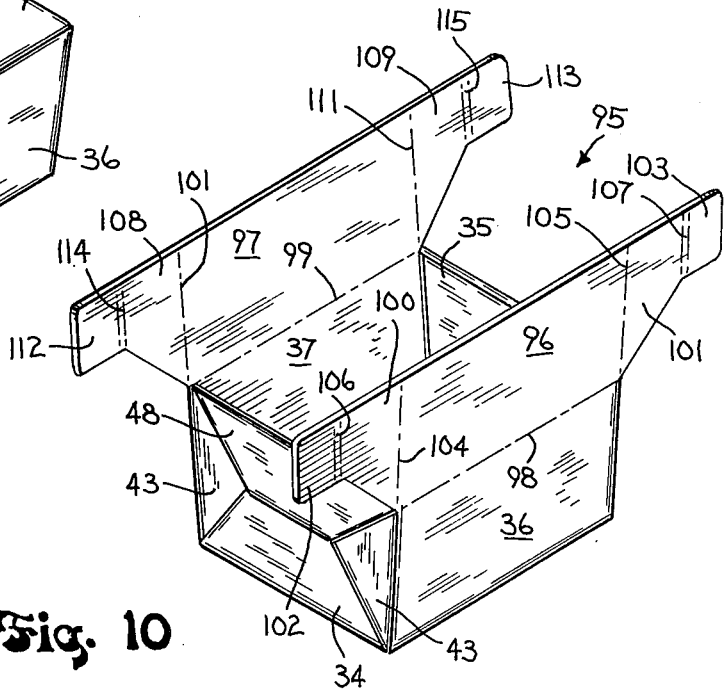

FIG. 10 is a perspective view of a receptacle according to a still further embodiment of the invention wherein the opposed closure flaps, shown in the open position, are intended to partially overlap each other in the closure position and each is provided with locking tabs; and FIG. 11 is a sectional view generally similar to that of FIG. 7 and shows the locking tabs in closure position for the receptacle of FIG. 10.

DESCRIPTION OF THE ILLUSTRATED EMBODIMENT

Referring to the drawings, the receptacle 30 is formed from the blank 31 which is stamped or cut from laminated paperboard to provide that the grain of the paperboard will be parallel to the length dimension of the receptacle. The paperboard is faced with a silicone treated release paper to provide the receptacle with an inner lining 32 to assure later clean release of the contents without paper residue. The paperboard blank 31 is appropriately scored, as hereinafter described, for fold assembly of the receptacle 30.

The receptacle 30 comprises a bottom 33, forward wall 34, rear wall 35 and opposed side walls 36 and 37. At least the side walls 36 and 37 representing the length dimension of the receptacle 30 flare outwardly to provide a draft taper toward the top opening of the receptacle and thereby provide for easier removal of the contents.

Figure 1:
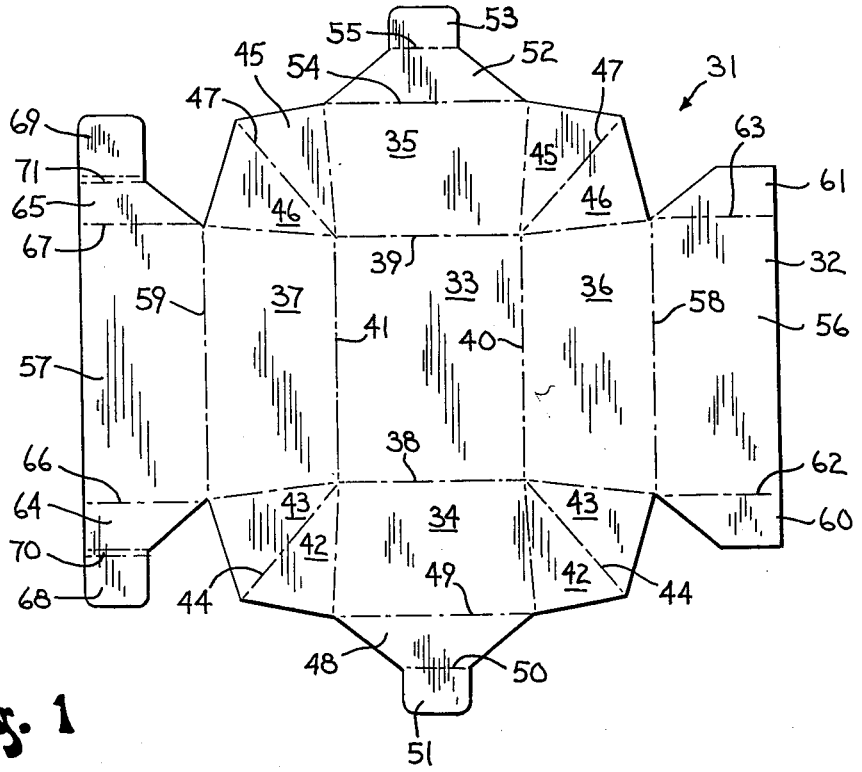
FIG. 1 is a plan view of the scored blank for forming the receptacle of this invention with the fold or score lines being shown as dot-dash lines.

Corresponding portions of the receptacle 30 are designated in the blank 31 of FIG. 1 with like reference numerals with the bottom portion 33 being separated from the forward wall portion 34 by the score lines 38, from the rear wall portion 35 by the score line 39, and from the opposed side wall portions 36 and 37 by the score lines 40 and 41, respectively. The blank 31 further includes front corner gusset portions 42 and 43 between the forward wall portion 34 and the respective side wall portions 36 and 37. Gusset portions 42 and 43 on each side of the forward wall portion 34 are separated by the score lines 44 which radiate from the forward corners formed between the bottom portion 33 and the respective side wall portions 36 and 37. Rear corner gusset portions 45 and 46 form a portion of the blank 31 between the rear wall portion 35 and the respective side wall portions 36 and 37. The gusset portions 45 and 46 to each side of the rear wall portion 35 are separated by the score lines 47 which radiate from the rear corners formed between the bottom portion 33 and the respective side wall portions 36 and 37.

The blank 31 also includes a projecting forward flap portion 48 separated from the front portion 34 by the score line 49. The flap projection 48 comprises generally a regular trapezoid having the score line 49 for its base and with the non-parallel sides tapering outwardly from the respective ends of the base to the score line 50 generally paralleling the base and separating a tab 51 from the balance of the flap projection. The rear wall portion 35 of blank 31 is similarly provided with the projecting rear flap portion 52 and tab 53 which are generally similar to the front flap projection 48 and tab 51. The rear flap projection 52 and tab 53 are defined by the score lines 54 and 55 respectively.

The blank 31 further includes opposed cover portions 56 and 57 which project outwardly from the respective side wall portions 36 and 37 and are separated therefrom by the corresponding score lines 58 and 59. Further detail in regard to the cover portions 56 and 57 and the mode of closure for the receptacle 30 will be treated hereinafter.

Figure 2:
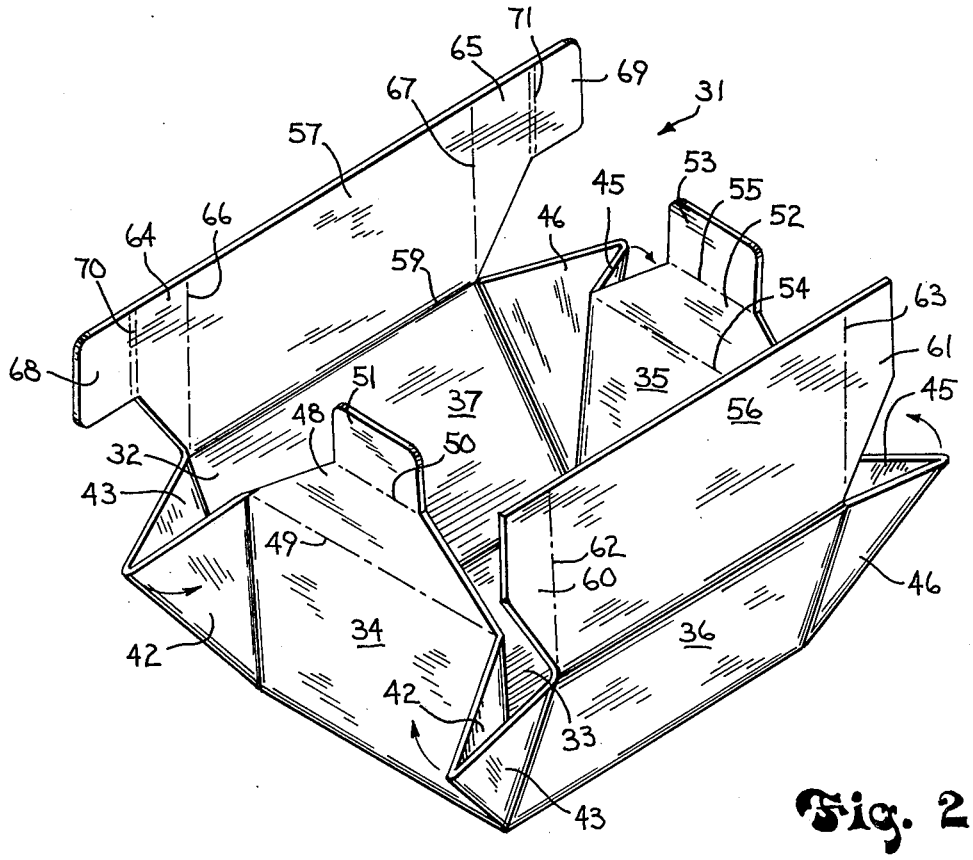
FIG. 2 is an enlarged perspective view with the blank creased along score lines to show the manner of folding the forward, rear and opposed side walls as well as the corner gussets.
Figure 3:
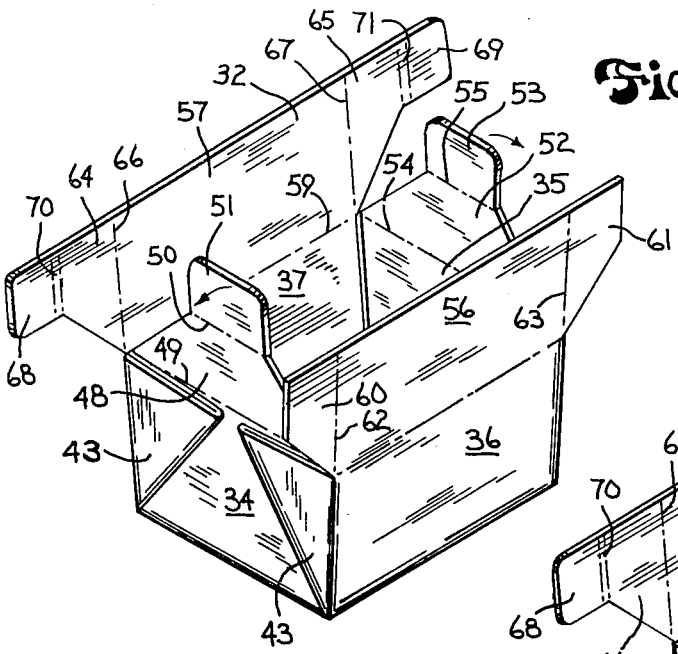
FIG. 3 is a perspective view of the partially folded receptacle with the forward corner gussets shown folded in opposed relation along the outside face of the forward wall.
Figure 4:
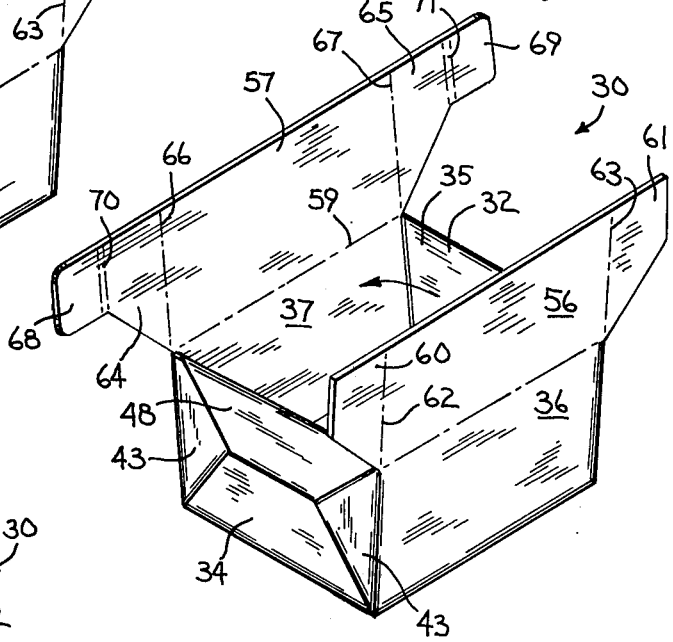
FIG. 4 is a perspective view of the folded receptacle with the first locking tabs in secured position and the cover closure fully open.

For fold assembly of the blank 31 to form the receptacle 30, at least the several score lines making up the receptacle proper or an open receptacle are initially creased as generally shown in FIG. 2. In the process of fold assembly, the several gusset corners are all creased on fold lines 44 and 47 to project outwardly of the receptacle 30 as shown in the FIG. 2 illustration. The assembly further requires the corresponding gusset corners to be folded over generally flush against the forward wall 34 and rear wall 35 as generally shown in FIG. 3. Next, the respective forward and rear flaps 48 and 52 are folded outwardly and down on fold lines 49 and 54, respectively, over the corresponding folded gusset corners. To assure a relatively sharp crease along the fold lines 49 and 54, the upper edge of the folded gusset corners taper downwardly relative to the corresponding fold lines 49 and 54 so that the ends of the gusset corners at the extremity of the fold lines 44 and 47 are clearly spaced below the fold lines 49 and 54 as shown in FIG. 3 and so do not materially interfere with the folding or creasing of the latter. With the respective flaps 48 and 52 folded down over the corresponding gusset corners at the front and back of the receptacle 30, the respective tabs 51 and 53 are folded on score lines 50 and 55 and tucked upwardly under the folded gusset corners as generally shown in FIGS. 4 and 7 of the drawings. With the grain of the paperboard running parallel to the length of the receptacle 30 and therefore perpendicular to the fold lines 50 and 55, the respective tabs 51 and 53 will be relatively more stiff in the corresponding direction to resist a curling effect during tucking and thus provide a sturdy and lasting receptacle without the aid of glue, tape or other fastening means.

Figure 5:
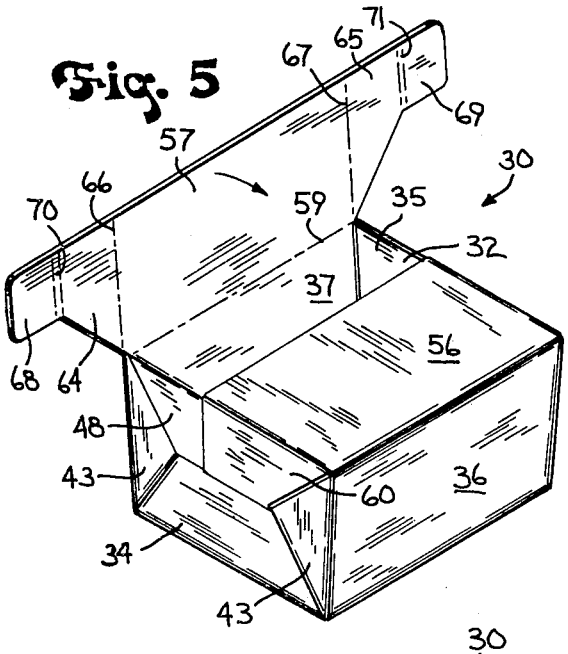
FIG. 5 is a perspective view of the receptacle and shows one of the cover closure flaps in closure position.

After the receptacle 30 is filled, with a liquid hot melt adhesive at up to 375° F. for example, it is ready for closure. To effect closure, the cover flap 56 is first folded down onto the top of the receptacle 30 on the score line 58 and the opposed forward and rear extensions 60 and 61 on the cover flap are folded down over the flaps 48 and 52 at the forward and rear walls, respectively, of the receptacle on the fold lines 62 and 63. As shown in FIG. 5, the cover flap 56 extends well beyond the midpoint of the top opening of receptacle 30. Cover flap 57 is then similarly folded down on score line 59 from the opposite side wall 37 of receptacle 30 and overlaps with the end of cover flap 56 to fully cover or enclose the contents of the receptacle. The opposed forward and rear extensions 64 and 65 on cover flap 57 are then folded down over the forward and rear flaps 48 and 52 and in overlapping relation with the extensions 60 and 61 of cover 56 on the fold lines 66 and 67 respectively. The tabs 68 and 69 separated from the opposed extensions 64 and 65 by the double score lines 70 and 71 are then tucked under the corresponding tabs 51 and 53 to provide a lasting, self-locking closure for the receptacle 30 without need for glue, tape or other fastening means. The double score lines 70 and 71 provide for the neat accommodation of the overlap between the cover flaps 56 and 57 and of the earlier tucking fold effected by the tabs 51 and 53 as clearly illustrated in the detail section of FIG. 7. Again, with the grain of the paperboard running parallel to the length of the receptacle 30 and therefore perpendicular to the fold lines 70 and 71, the tabs 68 and 69 are somewhat stiffened to resist curling of the tabs in the tucking operation. The structure and mode of assembly for the receptacle 30 provides for a generally sturdy and lasting container having self-contained locking closure to eliminate the glue, tape or other fastening means.

Figure 6:
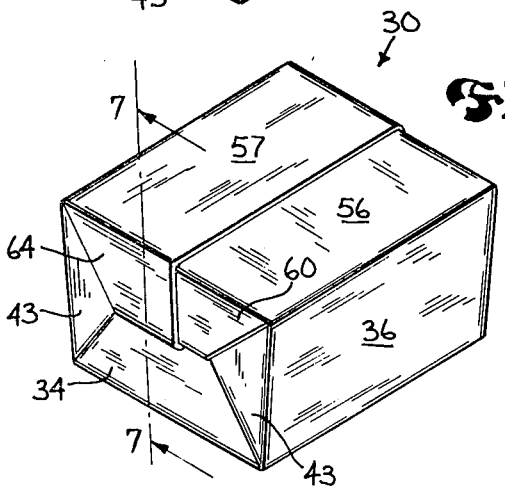
FIG. 6 is a perspective view of the receptacle fully closed.

The closed receptacle 30 as shown in FIGS. 6 and 7 lends itself also to easy opening to discharge its contents. Generally, a vigorous pull or yank on the free extremity of the overlapping cover 57 47 at or near its center will effect a release of the tabs 51, 53, 68 and 69 to expose the contents for discharge. Even if only the tabs 68 and 69 are released by a somewhat less vigorous pull on cover flap 57, the contents are nevertheless fully exposed for discharge.

Figure 8:
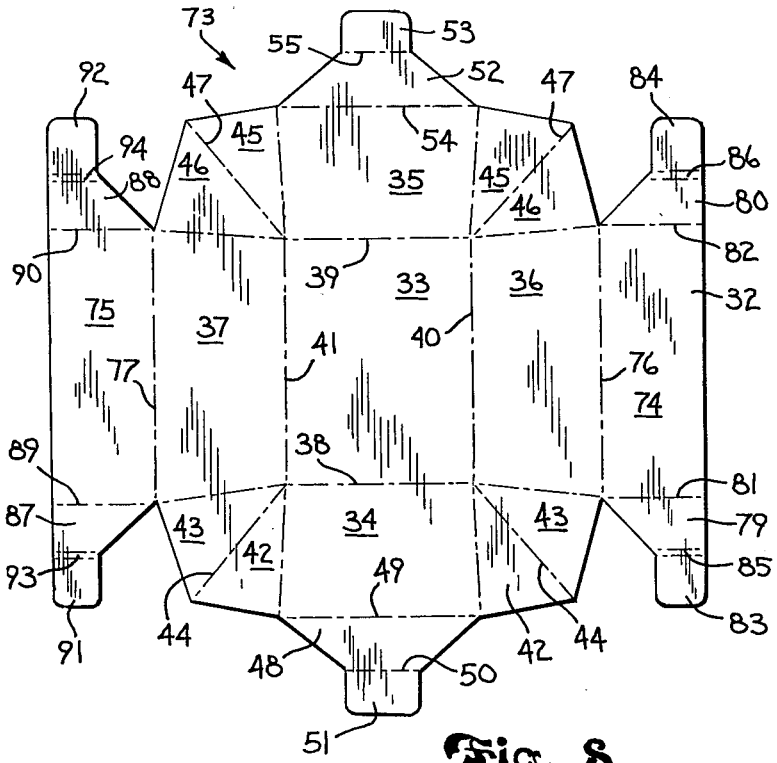
FIG. 8 is a plan view of a scored blank for a receptacle showing a further embodiment of the invention wherein the opposed closure flaps are intended to generally meet along the longitudinal centerline of the receptacle and are each provided with locking tabs.
Figure 9:
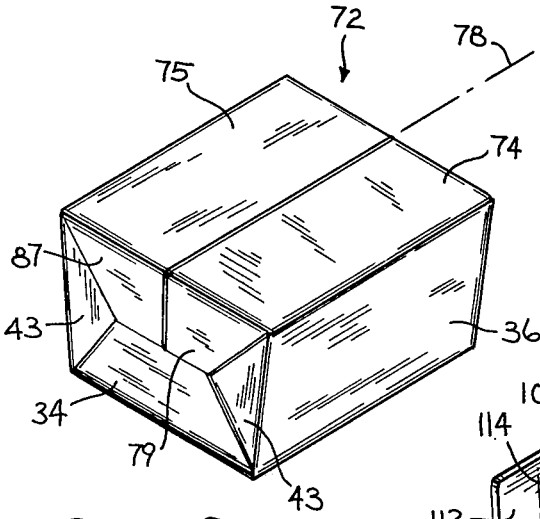
FIG. 9 is a perspective view of the receptacle formed from the blank of FIG. 8.

Referring now to the embodiment of FIGS. 8 and 9, the receptacle 72 results from the fold assembly of the scored blank 73. Like reference numerals indicate that the receptacle 72 is generally similar to that of the receptacle 30 of FIGS. 1–7 and differs therefrom only in the matter of closure.

In the receptacle 72, the opposed closure flaps 74 and 75 do not overlap one another in the closure position. Closure flaps 74 and 75 fold on the corresponding score lines 76 and 77 to effect closure with their extreme edges generally meeting at the centerline 78 of the receptacle.

To effect a lasting closure of receptacle 72, the closure flap 74 is provided with opposed forward and rear extensions 79 and 80 which are foldable downwardly on the score lines 81 and 82, respectively, to cover corresponding portions of the forward and rear flaps 48 and 52 of the receptacle. The extensions 79 and 80 in turn are provided with corresponding forwardly and rearwardly projecting locking tabs 83 and 84 foldable for tucking on the corresponding double score lines 85 and 86. To provide for lasting closure by the closure flap 74, the locking tab 83 is folded upwardly and under the tab 51 for securement between tab 51 and the outer face of the forward wall 34. The rear locking tab 84 is similarly folded upwardly for tucking under the tab 53 for securement between tab 53 and the outer face of the rear wall 35. Closure flap 75 is similarly provided with forward and rear extensions 87 and 88 foldable downwardly on score lines 89 and 90 to cover the corresponding portions of the forward and rear flaps 48 and 52 of the receptacle. Forwardly and rearwardly projecting locking tabs 91 and 92 are foldable on the corresponding double score lines 93 and 94. For lasting closure and closure flap 75, the forward locking tab 91 is folded upwardly and tucked for securement between the tab 51 and the outer face of the forward wall 34 and generally adjacent to the tucked locking tab 83. The rear locking tab 92 is similarly folded and tucked under the tab 53 for securement between the tab 53 and the outer face of the rear wall 35 and generally adjacent to the tucked locking tab 84.

The receptacle 95 of FIGS. 10 and 11, also differs from the receptacle 30 of FIGS. 1–7 in the mode of closure. In the receptacle 95, the closure flaps 96 and 97 fold downwardly into closure position on corresponding score lines 98 and 99 to provide for at least some overlap therebetween and each closure flap is provided with means for its securement.

Closure flap 96 includes forward and rear extensions 100 and 101 which carry corresponding forwardly and rearwardly projecting locking tabs 102 and 103. After the closure flap 96 is folded down into closure position on fold line 98, the respective extensions 100 and 101 are folded down on the corresponding score lines 104 and 105 over the previously secured flaps 48 and 52. Lasting securement for the closure flap 96 is provided by folding the respective locking tabs 102 and 103 upwardly on the double score lines 106 and 107 and tucking them up and under the corresponding previously secured tabs 51 and 53 in the manner shown in the partial detail view of FIG. 11. Closure flap 97 includes forward and rear extensions 108 and 109 that fold downwardly on the corresponding score lines 110 and 111 over the respective flaps 48 and 52 and the overlapped portion of the corresponding extensions 100 and 101. The respective extensions 108 and 109 in turn carry corresponding forwardly and rearwardly projecting locking tabs 112 and 113. The closure flap 97 is lastingly secured by folding the respective locking tabs 112 and 113 upwardly on the corresponding double score lines 114 and 115 and tucking them under the corresponding previously secured locking tabs 102 and 103 as shown in FIG. 11.

The receptacle of this invention lends itself to mechanical or machine set up and lasting, self-locking closure. The receptacle is readily and easily opened to expose the contents thereof for discharge. When the receptacle receives a hot melt adhesive in liquid form at up to 375° F. which is thereafter allowed to cool and solidify into a cohesive block at room temperature in the closed receptacle, clean release of the contents is assured without paper residue and/or fiber cling. The receptacle may well have other and diverse uses including the freezing of certain food products, the curing of cheese products, the solidification of certain confectionary materials such as chocolate and of rendered products such as lard, for the storage of uncured rubber compounds, and the solidification of soaps, waxes, gums and tars.

Various modes of carrying out the invention are contemplated as being within the scope of the following claims particularly pointing out and distinctly claiming the subject matter which is regarded as the invention.

We claim:

1. In a receptacle formed from a single piece of sheet material appropriately scored for fold assembly, said receptacle having a forward wall, rear wall and opposed side walls integrally connected to a bottom and providing for an upwardly facing opening, corner gussets between the forward wall and respective side walls and between the rear wall and respective side walls and projecting outwardly relative to the walls of the receptacle, said forward corner gussets being folded in opposed relation along the outside face of the forward wall of the receptacle, said rear corner gussets being folded in opposed relation along the outside face of the rear wall of the receptacle, a flap member on each said forward and rear wall, a first fore-and-aft extending locking tab on the free extremity of each flap member, said forward flap member being folded forwardly and downwardly over the corresponding opposed corner gussets with the first locking tab thereon being folded upwardly and under said corner gussets to lock the tab between said gussets and the outside face of the forward wall and thereby set up and lastingly secure the forward portion of the receptacle, said rear flap member being folded rearwardly and downwardly over the corresponding opposed corner gussets with the first locking tab thereon being folded upwardly and under said corner gussets to lock the tab between said gussets and the outside face of the rear wall and thereby set up and lastingly secure the rear portion of the receptacle, a first closure flap integral with one side wall of the receptacle and having opposed forward and rear extensions thereon, said first closure flap being foldable over the opening of the receptacle and with the opposed forward and rear extensions thereof being foldable downwardly over the corresponding folded flap members on said forward wall and rear wall of the receptacle, a second closure flap integral with the other of the opposed side walls of the receptacle and having opposed forward and rear extensions thereon, said second closure flap being foldable over the opening of the receptacle and overlapping with at least a portion of the first closure flap in the closure position to secure the latter in said closure position and with the opposed forward and rear extensions of said second flap being foldable downwardly in overlapping relation with the corresponding forward and rear extensions of the first closure flap to secure the latter in their closure position, and a fore-and-aft extending second locking tab on each of the opposed forward and rear extensions of the second closure flap, said second locking tab on the forward extension of the second closure flap being foldable upwardly and under the first locking tab on the forward flap member to lock the second locking tab on the forward extension of the second closure flap between said first locking tab and the outside face of the forward wall and thereby lastingly secure the forward portion of the receptacle closure flaps, said second locking tab on the rear extension of the second closure flap being foldable upwardly and under the first locking tab on the rear flap member to lock the second locking tab on said rear extension of said second closure flap between the first locking tab and the outside face of the rear wall and thereby lastingly secure the rear portion of the receptacle closure flaps.

2. In a blank of sheet material provided with score lines for the fold assembly of a receptacle having a closeable upwardly facing opening, the score lines on said blank designating a bottom, a forward wall, rear wall and opposed side walls for the receptacle radiating from said bottom, corner gussets provided for on the blank between the forward and respective side walls and between the rear and respective side walls, said forward corner gussets being foldable in opposed relation along the outside face of the forward wall in the assembly of the receptacle, said rear corner gussets being foldable in opposed relation along the outside face of the rear wall in the assembly of the receptacle, said blank further including a flap member on each said forward and rearward wall and a first locking tab on the free extremity of each flap member, said forward flap member being foldable forwardly and downwardly over the corresponding opposed corner gussets in the assembly of the receptacle with the first locking tab on said forward flap member being foldable upwardly and under said corner gussets to lock the tab between said gussets and the outside face of the forward wall and thereby set up and lastingly secure the forward portion of the receptacle, said rear flap member being foldable rearwardly and downwardly over the corresponding opposed corner gussets in the assembly of the receptacle with the first locking tab on said rear flap member being foldable upwardly and under said corner gussets to lock the tab between said gussets and the outside face of the rear wall and thereby set up and lastingly secure the rear portion of the receptacle, a first closure flap for the receptacle provided for on the blank integral with one of the side walls and having opposed forward and rear extensions thereon, said first closure flap being foldable over the opening of the assembled receptacle and with the opposed forward and rear extensions thereof being foldable downwardly over the corresponding folded flap members on said forward and rear walls of the assembled receptacle, a second closure flap for the receptacle provided for on the blank integral with the other of the opposed side walls and having opposed forward and rear extensions thereon, said second closure flap being foldable over the opening of the assembled receptacle and overlapping with at least a portion of the first closure in the closure position to secure the latter in said closure position and with the opposed forward and rear extensions of said second closure flap being foldable downwardly in overlapping relation with the corresponding forward and rear extensions of the first closure flap to secure the latter in their closure position, and said blank also including a fore-and-aft extending second locking tab on each of the opposed forward and rear extensions of the second closure flap, said second locking tab on the forward extension of the second closure flap being foldable upwardly and under the first locking tab on the forward flap member in the assembled receptacle to lock the second locking tab on the forward extension of the second closure flap between said first locking tab and the outside face of the forward wall and thereby lastingly secure the forward portion of the receptacle closure flaps, said second locking tab on the rear extension of the second closure flap being foldable upwardly and under the first locking tab on the rear flap member in the assembled receptacle to lock said second locking tab on the rear extension of the second closure flap between said first locking tab and the outside face of the rear wall and thereby lastingly secure the rear portion of the receptacle closure flaps.

3. The structure as set forth in claims 1 or 2 wherein the sheet material for the receptacle comprises a laminated paperboard.

4. The structure as set forth in claim 3 wherein the grain of the laminated paperboard extends in the direction of the projecting locking tabs.

5. The structure as set forth in claim 3 wherein the laminated paperboard is faced with a silicone treated paper that serves as an inner lining of the receptacle.

6. The structure as set forth in claims 1 or 2 wherein the free extremity of the first closure flap extends beyond the centerline of the opening of the assembled receptacle.

7. The structure as set forth in claims 1 or 2 wherein the free extremity of the respective closure flaps extend beyond the centerline of the opening of the assembled receptacle to provide the overlapping closure therebetween.

8. The structure as set forth in claims 1 or 2 wherein the respective flap members on the forward and rear walls of the receptacle comprise regular trapezoids having their base line along the upper edge of the corresponding walls and wherein the first locking tabs project generally centrally from the flap members from a line generally paralleling said base line.

9. The structure as set forth in claim 8 wherein the forward and rear extensions on the opposed closure flaps together generally comprise a regular trapezoid to generally cover the forward and rear flap members in the assembled and closed receptacle.

10. The structure as set forth in claims 1 or 2 wherein the first closure flap is provided with fore-and-aft extending locking tabs to provide for separate lasting securement for said closure flap.

11. In a receptacle formed from a single piece of sheet material appropriately scored for fold assembly, said receptacle having a forward wall, rear wall and opposed side walls integrally connected to a bottom and providing for an upwardly facing opening, corner gussets between the forward wall and respective side walls and between the rear wall and respective side walls and projecting outwardly relative to the walls of the receptacle, said forward corner gussets being folded in opposed relation along the outside face of the forward wall of the receptacle, said rear corner gussets being folded in opposed relation along the outside face of the rear wall of the receptacle, a flap member on each said forward and rear wall, a first fore-and-aft extending locking tab on the free extremity of each flap member, said forward flap member being folded forwardly and downwardly over the corresponding opposed corner gussets with the first locking tab thereon being folded upwardly and under said corner gussets to lock the tab between said gussets and the outside face of the forward wall and thereby set up and lastingly secure the forward portion of the receptacle, said rear flap member being folded rearwardly and downwardly over the corresponding opposed corner gussets with the first locking tab thereon being folded upwardly and under said corner gussets to lock the tab between said gussets and the outside face of the rear wall and thereby set up and lastingly secure the rear portion of the receptacle, a first closure flap integral with one side wall of the receptacle and having opposed forward and rear extensions thereon, said first closure flap being foldable over the opening of the receptacle and with the opposed forward and rear extensions thereof being foldable downwardly over the corresponding folded flap members on said forward wall and rear wall of the receptacle, a second closure flap integral with the other of the opposed side walls of the receptacle and having opposed forward and rear extensions thereon, said second closure flap being foldable over the opening of the receptacle and with the opposed forward and rear extensions thereof being foldable downwardly over the corresponding folded flap members on the forward wall and rear wall of the receptacle, the extremities of said first and second closure flaps in closure position generally meeting along the centerline of the receptacle, and a fore-and-aft extending second locking tab on each of the opposed forward and rear extensions of the first closure flap and a third fore-and-aft extending locking tab on each of the opposed forward and rear extensions of the second closure flap, said second and third locking tabs on the forward extensions of the respective closure flaps being foldable upwardly and under the first locking tab of the forward flap member to lock the second and third locking tabs between said first locking tab and the outside face of the forward wall and thereby lastingly secure the forward portion of the receptacle closure flaps, said second and third locking tabs on the rear extensions of the respective closure flaps being foldable upwardly and under the first locking tab of the rear flap member to lock the second and third locking tabs between said first locking tab and the outside face of the rear wall and thereby lastingly secure the rear portion of the receptacle closure flaps.

12. In a blank of sheet material provided with score lines for the fold assembly of a receptacle having a closeable upwardly facing opening, the score lines on said blank designating a bottom, a forward wall, rear wall and opposed side walls for the receptacle radiating from said bottom, corner gussets provided for on the blank between the forward and respective side walls and between the rear and respective side walls, said forward corner gussets being foldable in opposed relation along the outside face of the forward wall in the assembly of the receptacle, said rear corner gussets being foldable in opposed relation along the outside face of the rear wall in the assembly of the receptacle, said blank further including a flap member on each said forward and rearward wall and a first locking tab on the free extremity of each flap member, said forward flap member being foldable forwardly and downwardly over the corresponding opposed corner gussets in the assembly of the receptacle with the first locking tab on said forward flap member being foldable upwardly and under said corner gussets to lock the tab between said gussets and the outside face of the forward wall and thereby set up and lastingly secure the forward portion of the receptacle, said rear flap member being foldable rearwardly and downwardly over the corresponding opposed corner gussets in the assembly of the receptacle with the first locking tab on said rear flap member being foldable upwardly and under said corner gussets to lock the tab between said gussets and the outside face of the rear wall and thereby set up and lastingly secure the rear portion of the receptacle, a first closure flap for the receptacle provided for on the blank integral with one of the side walls and having opposed forward and rear extensions thereon, said first closure flap being foldable over the opening of the assembled receptacle and with the opposed forward and rear extensions thereof being foldable downwardly over the corresponding folded flap members on said forward and rear walls of the assembled receptacle, a second closure flap for the receptacle provided for on the blank integral with the other of the opposed side walls and having opposed forward and rear extensions thereon, said second closure flap being foldable over the opening of the assembled receptacle and with the opposed forward and rear extensions thereof being foldable downwardly over the corresponding folded flap members on said forward and rear walls of the assembled receptacle, the extremities of said first and second closure flaps in closure position generally meeting along the centerline of the assembled receptacle, and said blank also including a fore-and-aft extending second locking tab on each of the opposed forward and rear extensions of the first closure flap and a third fore-and-aft extending locking tab on each of the opposed forward and rear extensions of the second closure flap, said second and third locking tabs on the forward extensions of the respective closure flaps being foldable upwardly and under the first locking tab on the forward flap member of the assembled receptacle to lock the second and third locking tabs between said locking tab and the outside face of the forward wall and thereby provide for lasting securement of the forward portion of the receptacle closure flaps, said second and third locking tabs on the rear extensions of the respective closure flaps being foldable upwardly and under the first locking tab on the rear flap member of the assembled receptacle to lock the second and third locking tabs between said first locking tab and the outside face of the rear wall and thereby provide for lasting securement of the rear portion of the receptacle closure flaps.

* * * * *